US007205970B2

(12) United States Patent
Kim et al.

(10) Patent No.: US 7,205,970 B2
(45) Date of Patent: Apr. 17, 2007

(54) LIQUID CRYSTAL DISPLAY FOR WIDE VIEWING ANGLE, AND DRIVING METHOD THEREOF

(75) Inventors: Sang-Il Kim, Suwon (KR); Cheol-Woo Park, Suwon (KR); Young-Chol Yang, Kunpo (KR)

(73) Assignee: Samsung Electronics Co., Ltd. (KR)

( * ) Notice: Subject to any disclaimer, the term of this patent is extended or adjusted under 35 U.S.C. 154(b) by 41 days.

(21) Appl. No.: 10/233,869

(22) Filed: Sep. 3, 2002

(65) Prior Publication Data

US 2003/0058211 A1 Mar. 27, 2003

(30) Foreign Application Priority Data

Sep. 3, 2001 (KR) ..... 2001-53843

(51) Int. Cl.
*G09G 3/36* (2006.01)

(52) U.S. Cl. ..... 345/89; 345/87; 345/95; 345/104; 345/106

(58) Field of Classification Search ..... 345/87–106, 345/76, 204–207, 600, 690, 212, 589, 150–154, 345/1, 613, 75.2, 601, 77, 696; 310/316.1; 382/117

See application file for complete search history.

(56) References Cited

U.S. PATENT DOCUMENTS 5,298,915 A * 3/1994 Bassetti, Jr. ..... 345/696
5,489,918 A * 2/1996 Mosier ..... 345/89
5,805,117 A * 9/1998 Mazurek et al. ..... 345/1.3
5,852,429 A * 12/1998 Scheffer et al. ..... 345/100
5,894,300 A * 4/1999 Takizawa ..... 345/601
6,008,786 A * 12/1999 Kimura et al. ..... 345/89
6,040,812 A * 3/2000 Lewis ..... 345/89
6,040,814 A * 3/2000 Murakami et al. ..... 345/94
6,407,480 B1 * 6/2002 Nakanishi et al. ..... 310/316.01
6,414,664 B1 * 7/2002 Conover et al. ..... 345/89
6,417,825 B1 * 7/2002 Stewart et al. ..... 345/77
6,462,835 B1 * 10/2002 Loushin et al. ..... 358/1.9
6,504,524 B1 * 1/2003 Gates et al. ..... 345/107
6,515,641 B1 * 2/2003 Sagano et al. ..... 345/76
6,531,997 B1 * 3/2003 Gates et al. ..... 345/107
6,603,450 B1 * 8/2003 Yamazaki et al. ..... 345/75.2
6,611,249 B1 * 8/2003 Evanicky et al. ..... 345/102
6,683,595 B2 * 1/2004 Ikeda ..... 345/95
6,714,665 B1 * 3/2004 Hanna et al. ..... 382/117
6,753,854 B1 * 6/2004 Koyama et al. ..... 345/204
7,057,597 B2 * 6/2006 Ikeda ..... 345/95
2002/0024481 A1 * 2/2002 Kawabe et al. ..... 345/87
2002/0149598 A1 * 10/2002 Greier et al. ..... 345/589
2003/0058211 A1 * 3/2003 Kim et al. ..... 345/89
2003/0080926 A1 * 5/2003 Morimoto ..... 345/60
2003/0085906 A1 * 5/2003 Elliott et al. ..... 345/613

(Continued)

*Primary Examiner*—Bipin Shalwala
*Assistant Examiner*—Prabodh Dharia
(74) *Attorney, Agent, or Firm*—Cantor Colburn LLP

(57) ABSTRACT

A liquid crystal display and a driving method thereof. The liquid crystal display includes a timing controller, a gate driver, a data driver and a liquid crystal panel. The timing controller stores a plurality of sets of gray level correction values, each set of gray level correction values corresponding to each gray level and generates corrected gray level data in response to input gray level data, the corrected gray level data reflecting the gray level correction values corresponding to the input of gray level data. The brightness of the corrected gray level data is time-averaged to be equal to brightness of the input gray level data.

18 Claims, 10 Drawing Sheets

U.S. PATENT DOCUMENTS

2004/0090402 A1* 5/2004 Cheng ..... 345/77
2005/0024353 A1* 2/2005 Amundson et al. ..... 345/204
2005/0093850 A1* 5/2005 Mori et al. ..... 345/204

* cited by examiner

| | | | | | | | | | | | | |
|---|---|---|---|---|---|---|---|---|---|---|---|---|
| G1 | A | B | A | B | A | B | C | D | C | D | C | D |
| G2 | E | F | E | F | E | F | G | H | G | H | G | H |
| G3 | C | D | C | D | C | D | A | B | A | B | A | B |
| G4 | G | H | G | H | G | H | E | F | E | F | E | F |
| | | | | | | | | | | | | |

LIQUID CRYSTAL DISPLAY FOR WIDE VIEWING ANGLE, AND DRIVING METHOD THEREOF

BACKGROUND OF THE INVENTION (a) Field of the Invention

The present invention relates generally to a liquid crystal display and a driving method thereof, and more particularly to a liquid crystal display for wide viewing angle for suppressing occurrence of lower gray level inversion and a driving method thereof.

(b) Description of the Related Art

In general, the reason that a lower gray level inversion occurs in TN (twisted nematic) type LCD (liquid crystal display) is as follows. For the convenience of description, an ECB (electrical controlled birefringence) mode will be given. For an LCD of ECB mode, rubbing directions of lower and upper alignment films are equal or opposite each other, a twist angle is 0°, transmission axes of a polarization plate and a light-detection plate are perpendicular to each other, and transmission axis of the rubbing direction has an inclination of 45° with respect to the rubbing direction.

When each of three voltages, V1, V2, and V3 (V1<V2<V3) is applied to liquid crystal cells, liquid crystal directors are arranged as shown in FIG. 1.

FIG. 1 is a view of liquid crystal directors dependent on voltages applied to the liquid crystal cells.

As shown in FIG. 1, since a phase retardation by the liquid crystal is decreased with increase of an application voltage when light is perpendicular to a plane of the liquid crystal cell array, light can not pass through the liquid crystal cell if polarization plates are placed perpendicular to each other at lower and upper portions of the liquid crystal cells. In other words, the higher the voltage is, the lower the transmission rate is.

However, when light is incident a certain inclination angle with respect to the plane of the liquid crystal cell array, the transmission rate is decreased with gradual decrease of the phase retardation when the application voltage rises from V1 to V2 but is increased with gradual increase of the phase retardation when the application voltage rises from V2 to V3.

In other words, the transmission rate is high at a higher application voltage rather than a lower application voltage above a certain angle. This is referred to as "gray level inversion", which will be explained with reference to FIG. 2.

FIG. 2 illustrates a gray level indication according to a prior viewing angle.

Referring to FIG. 2, a normal gray level can be identified in the front sight of the liquid crystal panel, but an abnormal gray level may be identified in the sight from a position lower than the front. In other words, when the panel is observed above a certain angle in the sight from a position lower than the front, there is a problem of a lower gray level inversion that it is perceived that white gray level is inverted to black gray level and conversely.

Such a lower gray level inversion causes a problem of narrow viewing angle that viewing angle of the liquid crystal display becomes narrow.

One approach for solving the narrow viewing angle problem is to use a compensation film. However, this approach is excellent in improvement effect of CR (contrast ratio) but has a problem that gray level property is little improved.

In addition, another approach for solving the narrow viewing angle problem is to use an IPS (in plane switching) mode or a VA (vertical alignment) mode. However, this approach requires a complex process and has a problem of poor yield.

In the other hand, a flicker occurs in the liquid crystal display due to a swing of a common electrode voltage or a difference of response time of the liquid crystal. These reasons of occurrence of the flicker will be described with reference to FIGS. 3*a*, 3*b*, and 4 of the accompanying drawings.

Firstly, FIGS. 3*a* and 3*b* illustrate a flicker caused by a swing of common electrode voltage generated in a prior liquid crystal display. With reference to these figures, the liquid crystal display with a normal white mode, which has white gray level in case of no application of voltage to the pixel and black gray level in case of application of voltage to the pixel, will be described as an example.

More particularly, FIG. 3*a* shows pixel voltages applied to first to fourth pixels for each frame.

Referring to FIG. 3*a*, although a pixel application voltage should be applied around an ideal common electrode voltage (Ideal Vcom), since a common electrode voltage (Actual Vcom) is shifted by a certain level at the time of actual driving, the magnitude of the pixel voltage applied to the first frame becomes different from that of the pixel voltage applied to the second frame to thereby generate the flicker.

FIG. 3*b* shows pixel voltages actually felt by pixels, which are applied to the first to fourth pixels placed spatially in FIG. 3*a* for each frame.

Referring to FIG. 3*b*, as the second and third frames have brightness of (L−) and (H'+) in the entire screen and the first and fourth frames have brightness of (H−) and (L−), a brightness difference between the two brightness produces a flicker of 15 Hz component.

FIG. 4 is a diagram of a flicker caused by a difference of response time of the liquid crystal generated in a prior liquid crystal display, particularly (a) is for illustrating a voltage applied to a certain pixel for each frame (7 frames shown) and a brightness level responding to the voltage and (b) is for illustrating a voltage applied to a pixel adjacent to the certain pixel for each frame and a brightness level responding to the voltage.

Referring to FIG. 4, due to a difference between response time of when a low voltage is changed to a high voltage and that of when a high voltage is changed to a low voltage, a flicker occurs in a portion indicated by a circle in the entire screen when the pixels having two waveforms in the right and left are driven on their average.

SUMMARY OF THE INVENTION

The invention provides a liquid crystal display for wide viewing angle which is capable of suppressing the occurrence of the flicker and overcoming the lower gray level inversion problem by representing brightness indicated by more than two gray level voltages as one gray level through an inversion method or a method by which brightness pattern for each frame is optimized and time-averaged.

The invention further provides a driving method of the liquid crystal display for wide viewing angle.

According to one embodiment of the invention, a liquid crystal display for wide viewing angle comprises, a timing controller for storing more than one gray level correction values for averaging optically brightness level corresponding to gray level data in a memory and outputting average gray level data reflecting the gray level correction value in association with input of certain gray level data from the external;

a gate driver for outputting sequentially a predetermined scanning signal;

a data driver for receiving the average gray level data and transforming them into predetermined data voltages to be outputted; and a liquid crystal panel for displaying an image according to the data voltages when the scanning signals are inputted.

Preferably, the timing controller outputs average gray level data generated by averaging gray level data corresponding to more than one sub-pixels of each of RGBs based on the more than one gray level correction values as the gray data corresponding to the sub pixels of each of RGBs is applied from the external.

Preferably, the timing controller has a signal processing unit for producing and outputting a first control signal to be inputted to the data driver, a second control signal to be inputted to the gate driver, and a third control signal to be inputted to a driving voltage generating unit; and a gray level averaging unit for outputting the average gray level data produced by averaging gray levels of image data from the external.

In another embodiment of the invention, a driving method of a liquid crystal display including a plurality of gate line, a plurality of data lines intersecting the plurality of gate line perpendicularly, pixel electrodes formed in regions between the gate lines and the data lines, and switching devices connected to the gate lines, the data lines, and the pixel electrodes, comprises the steps of: (a) receiving gray level data for picture display from an external source of picture signals; (b) generating average gray level data reflecting gray level correction values corresponding to the gray level data; (c) converting the average gray level data into data voltages; (d) applying the data voltages to the data lines; and (e) applying sequentially scanning signals for output of the data voltages to the gate lines.

Preferably, the step of (b) includes (b-1) extracting first and second gray level correction values corresponding to the gray level data from a memory; and (b-2) generating the average gray level data reflecting the first and second gray level correction values.

Preferably, the first gray level correction value is a voltage for driving the pixel electrodes at a level lower than the gray level data and the second gray level correction value is a voltage for driving the pixel electrodes at a level higher than the gray level data.

Preferably, the average gray level data in the step of (b-2) generates a first average gray level data by subtracting the first gray level correction value from the gray level data, the generated first average gray level data being applied when odd or even numbers of frames are driven, and a second average gray level data by subtracting the second gray level correction value from the gray level data, the generated second average gray level data being applied when odd or even number of frames are driven.

Preferably, the average gray level data in the step of (b-2) is the first gray level correction value corresponding to the gray level data when the odd numbers of frames are driven and the second gray level correction value corresponding to the gray level data when the even numbers of frames are driven.

According to the liquid crystal display for wide viewing angle and the driving method thereof, the lower gray level inversion problem in the TN mode can be overcome by representing brightness indicated by more than two gray level voltages as one gray level through an inversion method or a method by which brightness pattern for each frame is optimized and time-averaged.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENT

Preferred embodiments of the present invention will be now described in detail with reference to the accompanying drawings.

To begin with, premised conditions on a method for averaging more than two gray levels using a driving method according to the present invention are as follows.

First, gray level to be averaged for each gray level should be calculated for same measurement as gamma curve prior to the gray level averaging.

Second, magnitude of positive and negative polarities should be symmetrical without DC component during a constant period in one pixel.

Third, brightness average should be constant in a constant period in one pixel.

Fourth, There should be no variation of brightness of the entire screen due to a swing of a common electrode voltage.

Fifth, pixels with different screen brightness due to difference of response time of liquid crystals should be properly averaged so that an observer cannot perceive the brightness difference.

Figure 1:
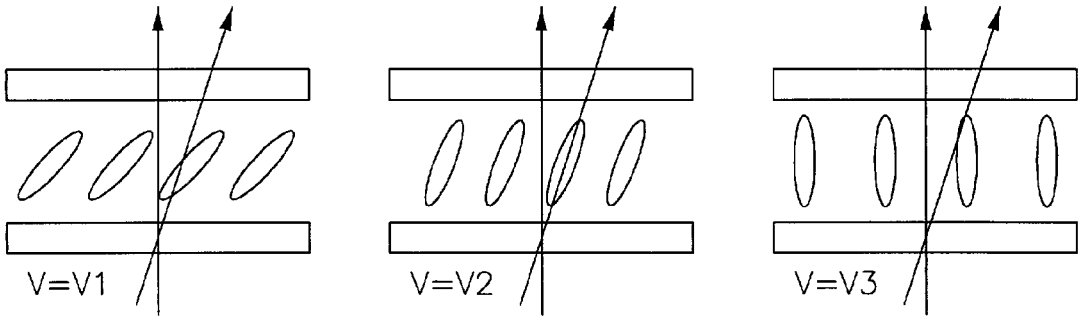
FIG. 1 illustrates an array of liquid crystal directors dependent on voltages applied to the liquid crystal cell.
Figure 2:
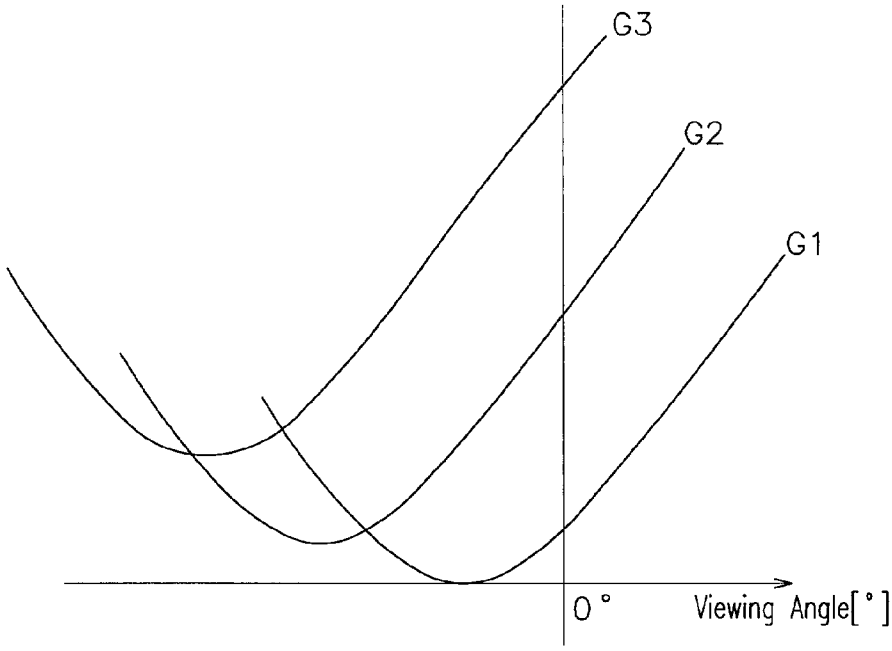
FIG. 2 is a diagram of a gray level indication according to a prior viewing angle.
Figure 3A:
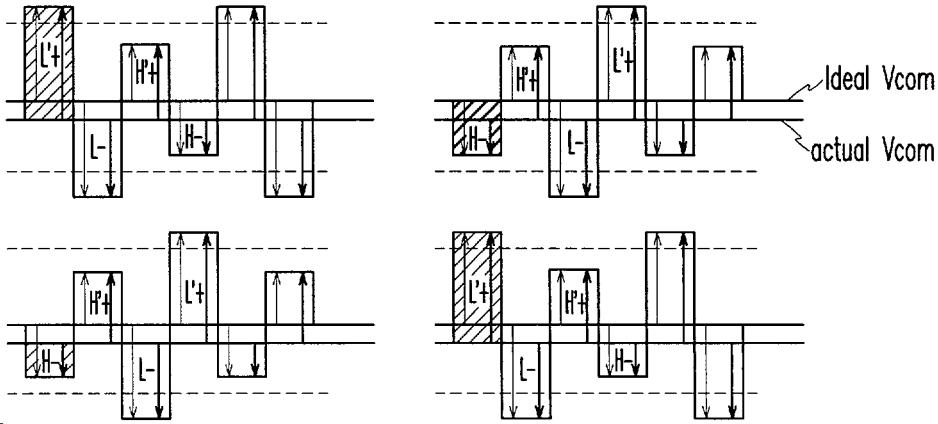
FIGS. 3A and 3B illustrate a flicker caused by a swing of common electrode voltage generated in a prior liquid crystal display.
Figure 3B:
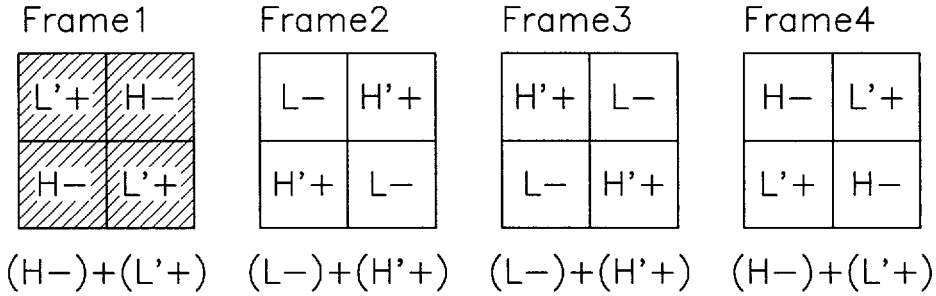
Figure 4:
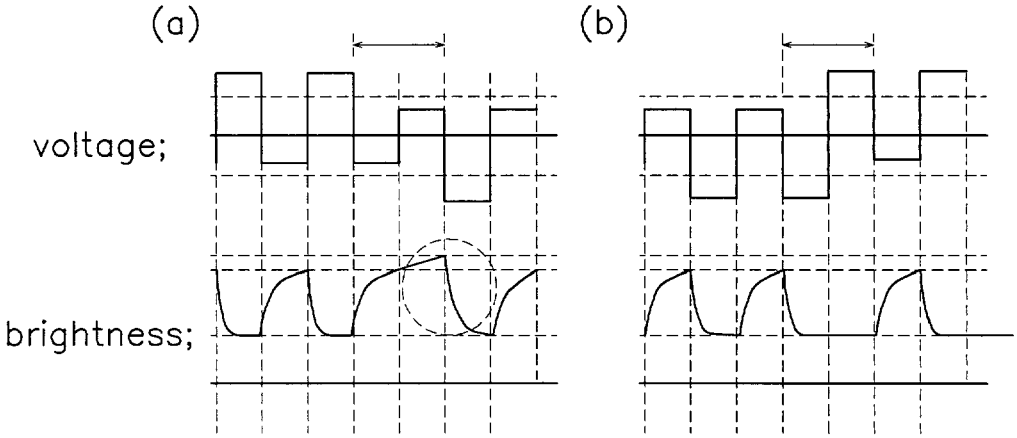
FIG. 4 illustrates a flicker caused by a difference of response time of the liquid crystal generated in a prior liquid crystal display.
Figure 5:
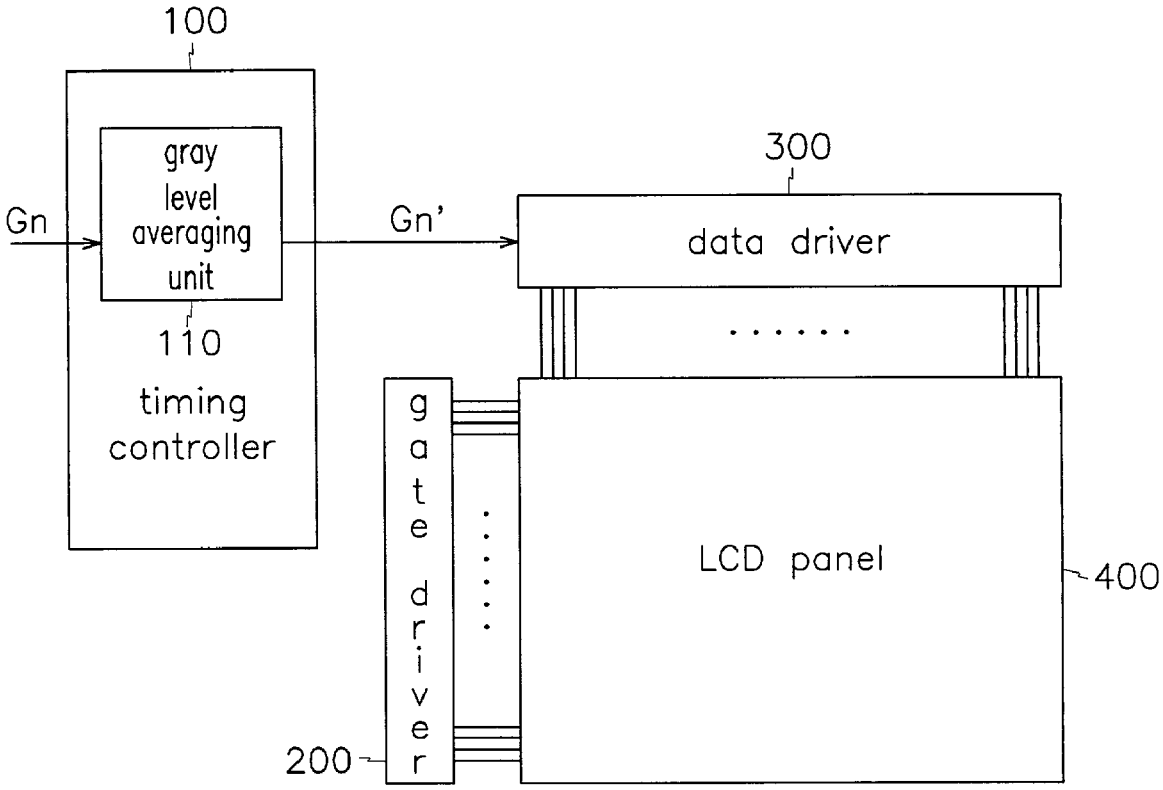
FIG. 5 is a block diagram illustrating a liquid crystal display for wide viewing angle according to an embodiment of the present invention.

FIG. 5 shows a liquid crystal display for wide viewing angle according to an embodiment of the present invention.

Referring to FIG. 5, a liquid crystal display for wide viewing angle includes a timing controller 100 including a gray level averaging unit 110, a gate driver 200, a data driver 300 and a liquid crystal panel 400.

The timing controller 100 outputs gray level data Gn' averaged based on gray level data Gn supplied to the data driver 300.

More specifically, the timing controller 100 stores in a memory first and second gray level correction values for optically averaging a brightness level corresponding to gray level data using the inversion method or a method of optimizing and time-averaging a brightness pattern for each frame and outputs averaged gray level data Gn' reflecting the first and second gray level correction values in association with a particular gray level input data Gn.

The gate driver 200 applies scan signals (or gate ON voltages) to the liquid crystal panel 400 based on a timing signal (not shown) from the timing controller 100 and turns on TFTs where gate electrodes are connected to gate lines to which the gate ON voltages are applied.

The data driver 300 converts averaged gray level data Gn' from the timing controller 100 to data voltages and outputs the data voltages to the liquid crystal panel 400.

The liquid panel 400 has a plurality of gate lines S1, S2, S3, . . . , Sn for transferring the gate ON signals and a plurality of data lines D1, D2, . . . , for transferring the data voltages. Each of regions surrounded by the gate lines and the data lines forms a pixel. Each of pixel includes a thick film transistor having a gate electrode and a source electrode connected to a corresponding gate line and a corresponding data line, respectively, and a liquid capacitor Clc and a storage capacitor Cst connected in parallel to a drain electrode of the thick film transistor.

Although a gray level averaging unit incorporated into the timing controller has been illustrated as an example, it is noted that the present invention includes a stand-alone gray level averaging unit separated from the timing controller.

Now, the timing controller including the gray level averaging unit will be in detail described with reference to the attached drawings.

Figure 6:
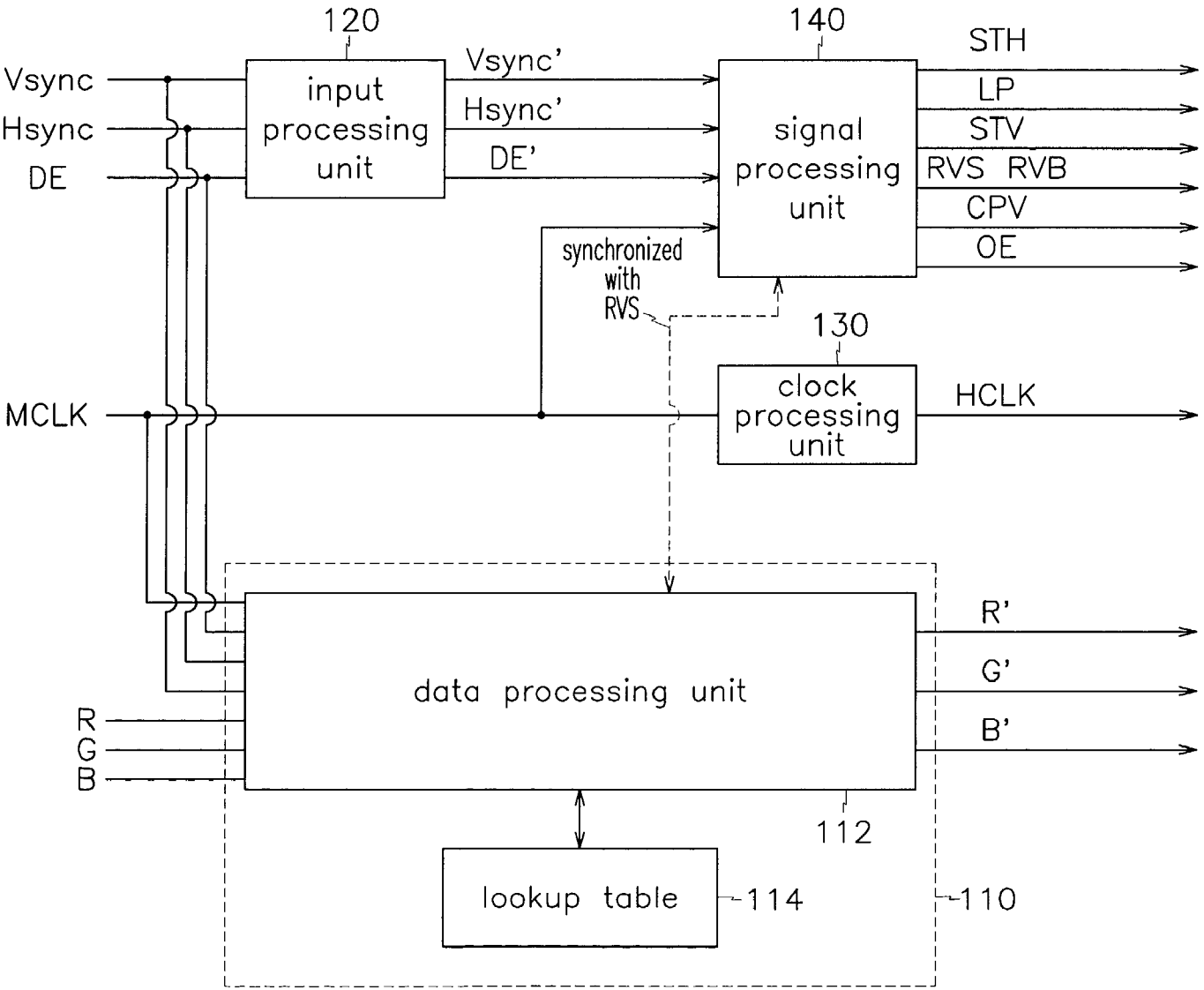
FIG. 6 is a detailed view of the timing controller of FIG. 5.

FIG. 6 shows a detailed view of the timing controller of FIG. 5.

Referring to FIG. 6, the timing controller of the present invention includes the gray level averaging unit 110, an input processing unit 120, a clock processing unit 130 and a signal processing unit 140.

The gray level averaging unit 110 having a data processing unit 112 and a lookup table 114 further performs function of averaging gray levels of the input picture data, along with well-known functions by which data from an external graphic controller (not shown) are frequency-divided (or pre-scaled) or pushed such that the data are conformable to a timing required by the gate driver 200 and the data driver 300.

More specifically, the lookup table 114 stores the first and second gray level correction values produced by time-averaging brightness exhibited by more than two voltages using the inversion method or the method of optimizing a brightness pattern for each frame. It is preferable to store the first and second gray level correction values designed to be optimized to the liquid crystal panel.

The data processing unit 112 extracts the first gray level correction value or the second gray level correction value from the lookup table 114 based on gray level data Gn for each of R, G and B and outputs average gray level data Gn' or R'G'B' reflecting the extracted correction values to the data driver 300. At that time, it is preferable that average gray level data from the data processing unit 112 responses to a vertical synchronization signal Vsync, a horizontal synchronization signal Hsync, a data enable signal DE and a main clock MCLK.

Here, average gray level data Gn' may be outputted through an operation for subtracting/adding the first or second gray level correction value from/to particular gray level data, or outputted as the first or second gray level correction value. At that time, it is preferable that output of average gray level data responds to the particular gray level data for being synchronized to line inversion signals RVS or /RVS from the signal processing unit.

The input processing unit 120 facilitates operation in the data processing unit 112 and the signal processing unit 140 by making slight fluctuating signals from the external graphic controller (not shown) constant. In other words, this unit is a portion for removing variations of random input signals, for example, variation of the number of vertical synchronization signals within one frame period, variation of reset period per line based on modes, or variation of the number of clocks within 1 H period or generating a constant output regardless of such irregular variations.

The clock processing unit 130 is a portion for adjusting clocks such that data and clocks come into the data driver 300 with a proper timing. This unit is a portion required to have a minimal timing error in the timing controller 100.

The signal processing unit 140 has counters and decoders for generating control signals to be inputted to the gate diver 200, the data driver 300 and a driving voltage generation unit (not shown).

More specifically, the signal processing unit 140 directly produces various control signals, for example, a horizontal synchronization start signal STH, a load signal LP, a gate clock, a horizontal synchronization start signal STV, a line inversion signal RVS or /RVS, a gate ON enable signal CPV, etc., required by the gate diver 200, the data driver 300 and the driving voltage generation unit based on the input vertical synchronization signal Vsync being a frame discrimination signal, the horizontal synchronization signal Hsync being a line discrimination signal, which are inputted from the external graphic controller, and the data enable signal DE for outputting a high level of signal only during an interval of data output.

Particularly, the line inversion signal RVS or /RVS is applied to the driving voltage generation unit for generating a gate ON voltage Von and a gate OFF voltage Voff to be outputted by the gate driver 200, and the data processing unit 112 of the gray averaging unit 110.

Here, the driving voltage generation unit generates a common electrode voltage Vcom and an inverted common electrode voltage/Vcom inverted in phase and a gate ON voltage Von and a gate OFF voltage Voff inverted in phase, based on the input RVS and RVSB swing from 0 volt to 5 volt with 1 H period.

Although it has been illustrated that the lookup table controller storing the gray level correction values is incorporated into the timing controller in the above embodiment, it is noted that the present invention includes a stand-alone lookup table separated from the timing controller.

Figures 7A, 7B:
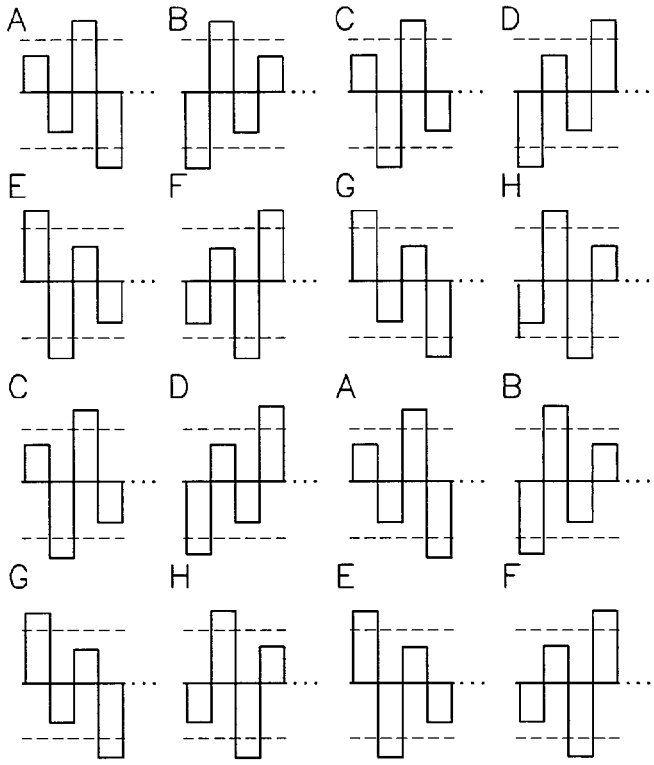
FIGS. 7*a* and 7*b* illustrate averaging two gray levels according to an embodiment of the present invention.

FIGS. 7*a* and 7*b* illustrate averaging two gray levels, particularly, in a ratio of 1:1 according to an embodiment of the present invention. More particularly, FIG. 7*a* shows a pattern of the liquid crystal panel optimal for adopting an 1:1 average driving method of two gray levels and FIG. 7*b* shows an application pattern for each frame of the gray level voltage applied to FIG. 7*a*.

As shown in FIG. 7*a*, according to the average driving method of two gray levels according to the embodiment of the present invention, gray level voltages are applied with spatially arrayed 12×4 pixels as one unit as shown in FIG. 7*a* and with, preferably, 4 frames for each temporal frame as one unit as shown in FIG. 7*b*. Here, the pixels can be pixels of each of R, G and B or can be pixel unit grouping the RGB into one unit.

In operation, when first and second frames, fifth and sixth frames, etc., are driven, a gray level voltage A less than a normal gray level voltage (plotted as a broken line) is applied to a first gate line of a first data line. When third and fourth frames, seventh and eighth frames, etc., are driven, a gray level voltage A higher than the normal gray level voltage is applied to the first gate line of the first data line.

Here, the gray level voltage less than the normal gray level voltage may a voltage corresponding to gray level data resulted from the subtraction of a first gray level correction value from the input gray level data n from the external or may a voltage corresponding to the first gray level correction value corresponding to the gray level data.

In addition, the gray level voltage higher than the normal gray level voltage may a voltage corresponding to gray level data resulted from the addition of a second gray level correction value from the input gray level data n from the external or may a voltage corresponding to the second gray level correction value corresponding to the gray level data.

Although it has been illustrated that the gray level is represented by averaging two voltages for all sub pixel of the RGB in the above embodiment, the gray level can be represented by differentially applying voltage only for one or two sub-pixels of the RGB.

Now, in order to implement the 1:1 average driving method of two gray levels according to the embodiment of the present invention, operation procedure for the first gray level correction value m and the second gray level correction value m' stored in the lookup table corresponding to gray level data from the external will be described with reference to FIG. 8.

Figure 8:
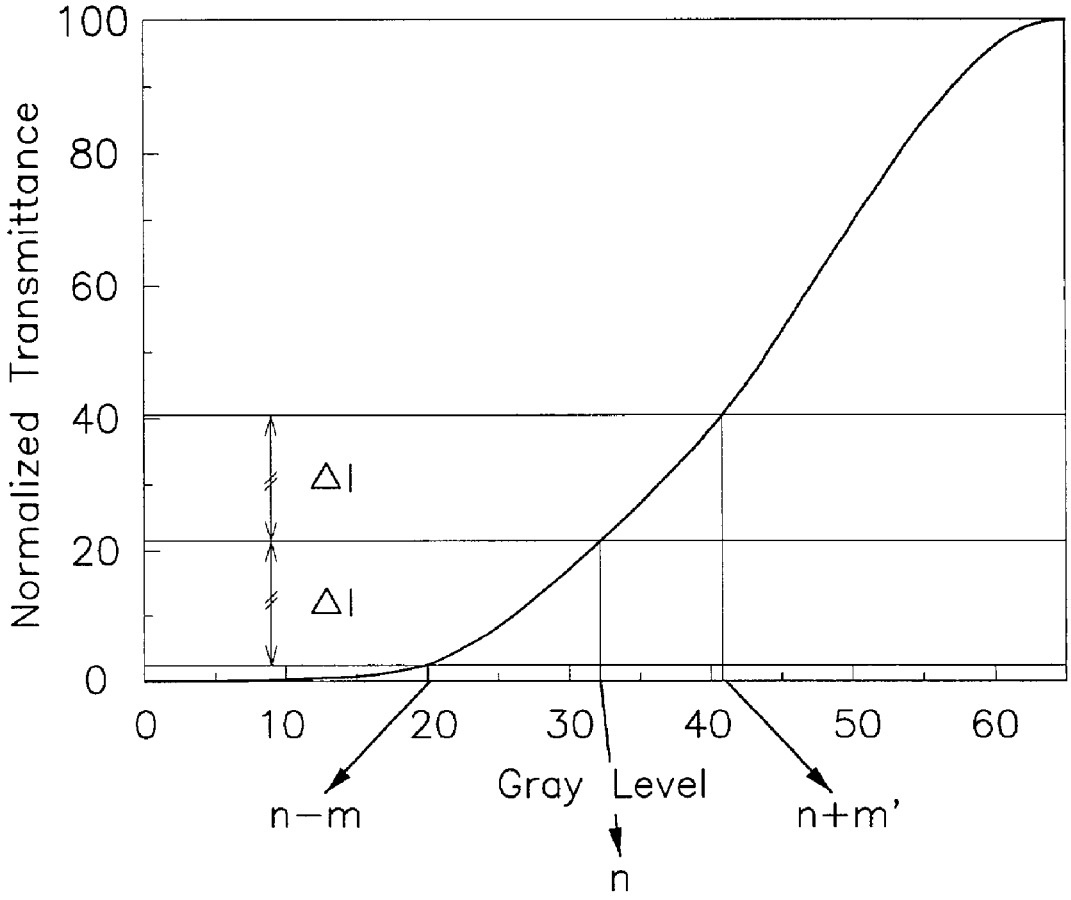
FIG. 8 shows an operation of m and m' for a particular n on a gamma curve of FIGS. 7*a* and 7*b;*

FIG. 8 illustrates an operation of m and m' for a particular n on a gamma curve for the liquid crystal display for wide viewing angle as described in FIGS. 7*a* and 7*b*. Here, the gamma curve represents a relation between each gray level and light transmissivity and m and m' are assumed to be the first and second gray level correction value, respectively.

Referring to FIG. 8, designers of the liquid crystal display obtain m and m' values by finding G(n−m) and G(n+m'), which have a difference by ΔI between them, for light transmissivity I(n) of a particular gray level G(n). Here, ΔI in which gray level inversion is not generated within a range in which visibility is not seriously affected may be obtained while magnitude of ΔI is adjusted.

If full gray level is assumed to be 64 gray levels, conditions of (I(n)+ΔI)>I(64) or (I(n)+ΔI)<I(1) can be satisfied in gray levels close to white and black. At that time, m and m' satisfying conditions of (I(n)+ΔI)=I(64) or (I(n)+ΔI)=I(1) are used. Naturally, ΔI in this region has values different from those in an intermediate region.

Here, a relation among n, m and m' can be represented as the following expression.

$$I(n) = \frac{I(n-m) + I(n+m')}{2}$$

where, if full gray level of the liquid crystal display is assumed to be 64 gray levels, n is 64 for white gray level and I for black gray level. Also, m and m' are the first gray level correction value and the second gray level value, respectively, and m+m' is preferably at least 20.

Figure 9A:
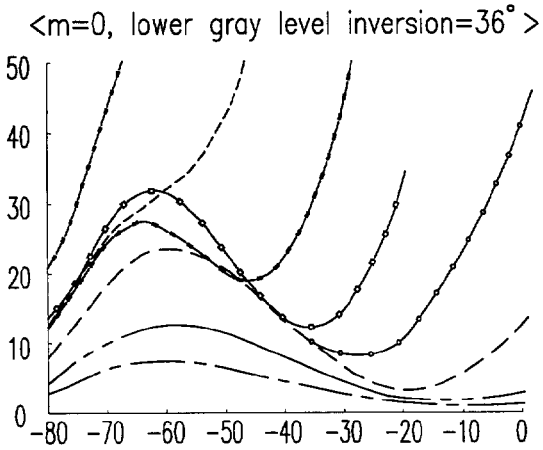
FIGS. 9*a* to 9*d* are graphs showing optical properties of the lower gray level inversion based on viewing angles corresponding to the values of m defined according to the present invention.
Figure 9B:
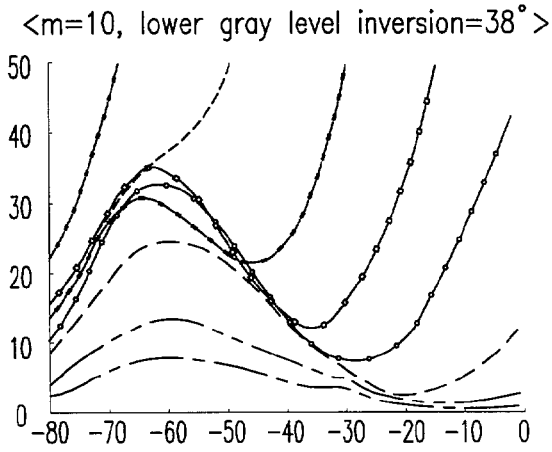
Figure 9C:
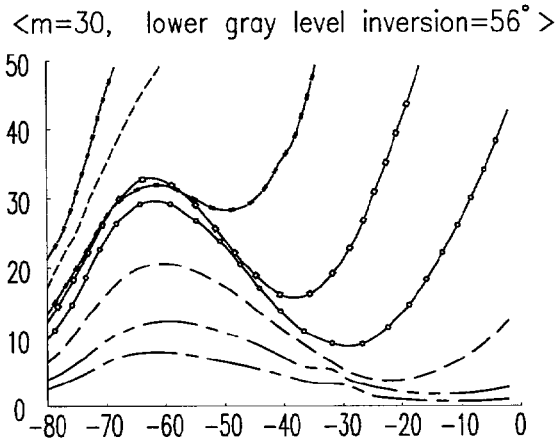
Figure 9D:
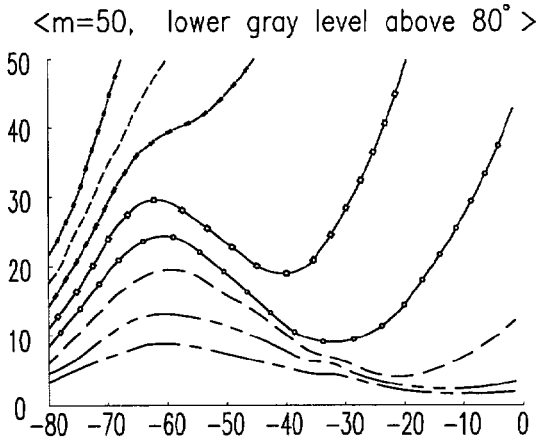
Figure 9D:
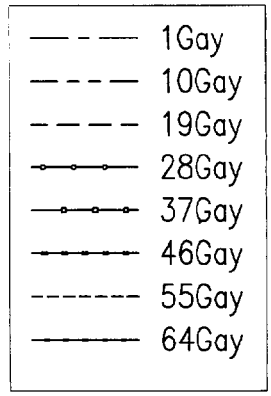

FIGS. 9*a* to 9*d* are graphs showing optical properties of the lower gray level inversion based on viewing angles corresponding to the values of m defined according to the present invention. Particularly, FIG. 9*a* is a graph showing optical property that the lower gray level inversion is generated at a viewing angle of 36° when m is set to '0', FIG. 9*b* is a graph showing optical property that the lower gray level inversion is generated at a viewing angle of 38° when misset to '10', FIG. 9*c* is a graph showing optical property that the lower gray level inversion is generated at a viewing angle of 56° when m is set to '30', and FIG. 9*d* is a graph showing optical property that the lower gray level inversion is generated above a viewing angle of 80° when m is set to '50'.

Referring to FIGS. 9*a* to 9*d*, it can be confirmed that a viewing angle at which the lower gray level inversion is generated is increased as the value of m is increased.

Figure 10:
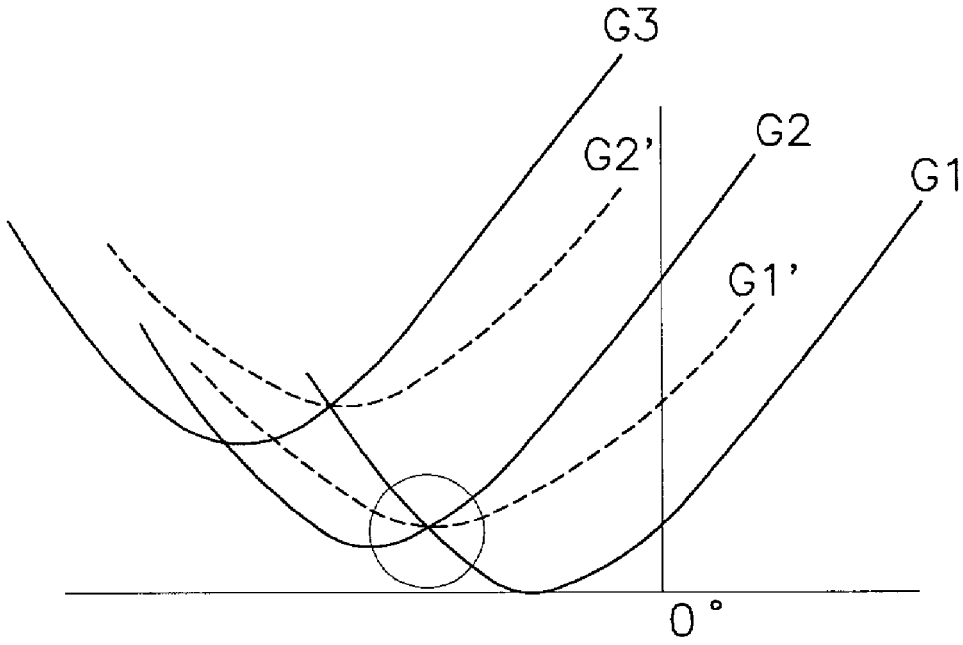
FIG. 10 is a graph for illustrating gray level display according to the present invention.

FIG. 10 is a graph for illustrating gray level display according to the present invention.

Referring to FIG. 10, it can be confirmed that the gray level inversion is not generated at gray level values G1' and G2' obtained by the averaging operation of the present invention although the gray level is generated in a portion indicated by a circle at gray level values G1, G2 and G3 corresponding to the gray level of the conventional liquid crystal display.

As described above, according to the embodiment of the present invention, gray level to be averaged for each gray level can be calculated for same measurement as gamma curve prior to the gray level averaging. Also, it can be confirmed that a brightness average is constant in one pixel in a constant period by satisfying conditions that magnitude of positive and negative polarities should be symmetrical without DC component during a constant period in one pixel.

In addition, since there is no variation of brightness of the entire screen due to a swing of a common electrode voltage, the cause of flicker generated by the swing of the common electrode voltage can be removed. Also, since pixels with different screen brightness due to difference of response time of liquid crystals can be properly averaged so that an observer cannot perceive the brightness difference, the cause of flicker generated by the difference of the response time of the liquid crystals can be removed.

Figure 11A:
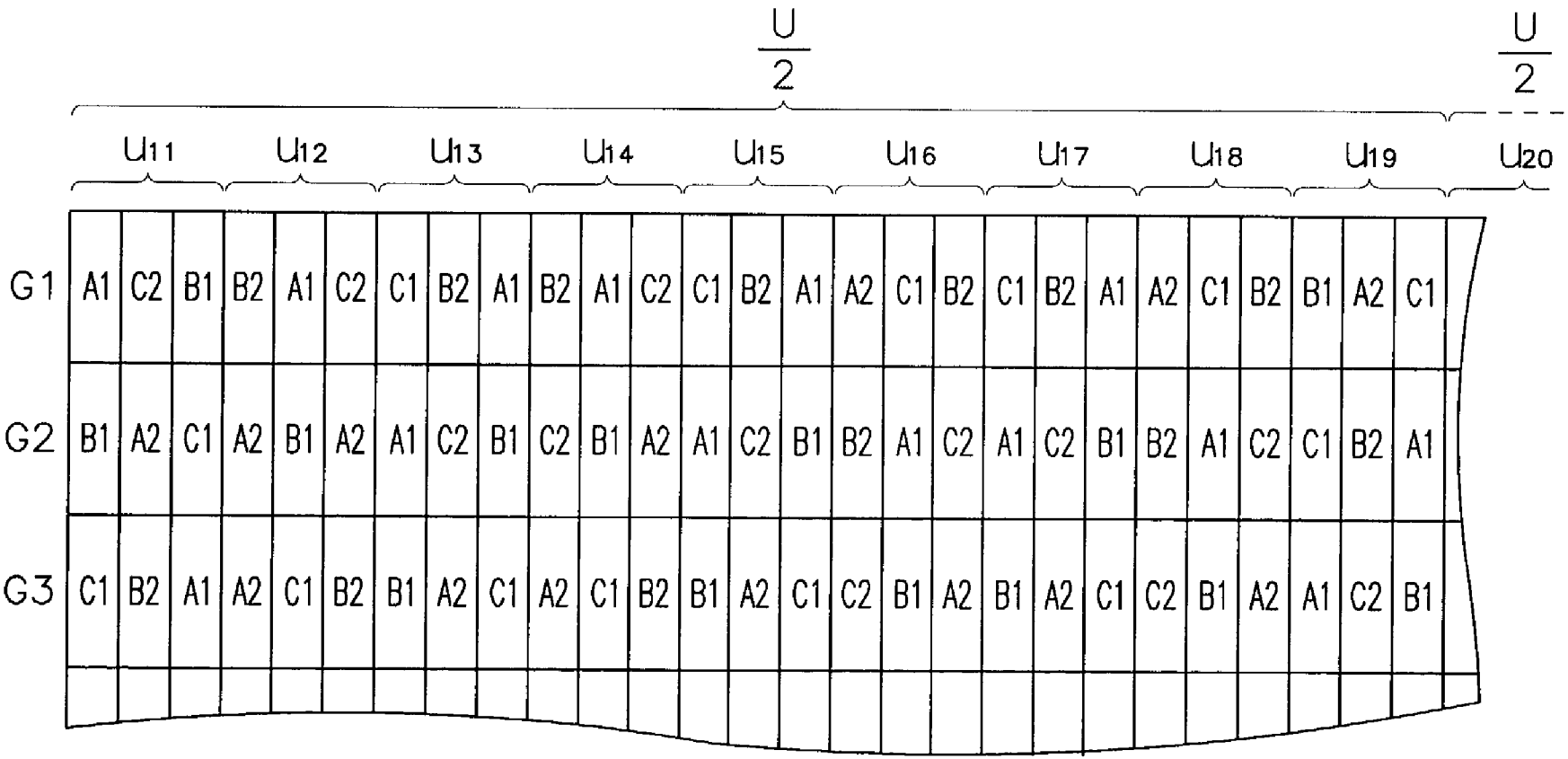
FIGS. 11*a* and 11*b* illustrate averaging two gray levels according to another embodiment of the present invention.
Figure 11B:
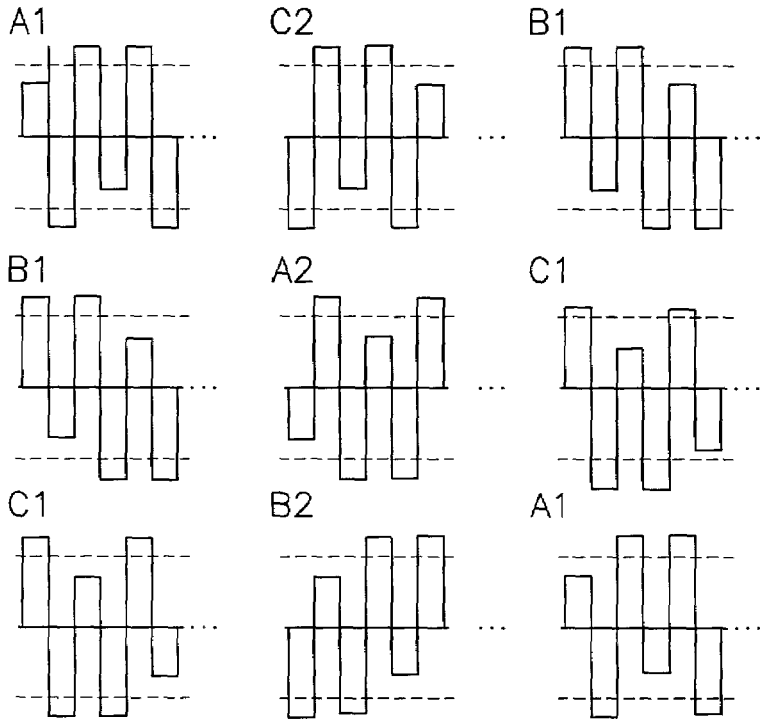

FIGS. 11*a* and 11*b* illustrate averaging two gray levels, particularly, in a ratio of 2:1, according to another embodiment of the present invention. More particularly, FIG. 11*a* shows a pattern of the liquid crystal panel optimal for adopting an 2:1 average driving method of two gray levels and FIG. 11*b* shows an application pattern for each frame of the gray level voltage applied to FIG. 11*a*.

As shown in FIG. 11*a*, according to the average driving method of two gray levels according to the embodiment of the present invention, gray level voltages are applied with spatially arrayed 54×3 pixels as one unit as shown in FIG. 11*a* and with, preferably, 6 frames for each temporal frame as one unit as shown in FIG. 11*b*. Here, the pixels can be pixels of each of R, G and B or can be pixel unit grouping the RGB into one unit.

Particularly, as shown in FIG. 11*a*, only half unit having 27×3 pixels is shown in the figure. In the remaining half unit, the gray level voltage is applied to each of frame while pixels are altered in a manner of A1<–>A2, B1<–>B2, and C1<–>C2 (i.e in a manner of inversion relation for each frame).

For example, when first frame, fourth frame, etc., are driven, a gray level voltage A1 less than a normal gray level voltage is applied to a first gate line of a first data line. When second and third frames, fifth and sixth frames, etc., are driven, a gray level voltage higher than the normal gray level voltage is applied to the first gate line of the first data line.

Here, the gray level voltage less than the normal gray level voltage may a voltage corresponding to gray level data n−m resulted from the subtraction of a first gray level correction value m from the input gray level data n from the external or may a voltage corresponding to the first gray level correction value m corresponding to the gray level data.

Now, in order to implement the 2:1 average driving method of two gray levels according to the embodiment of the present invention, operation procedure for the first gray level correction value m and the second gray level correction value m' stored in the lookup table corresponding to gray level data from the external will be described with reference to FIG. 12.

Figure 12:
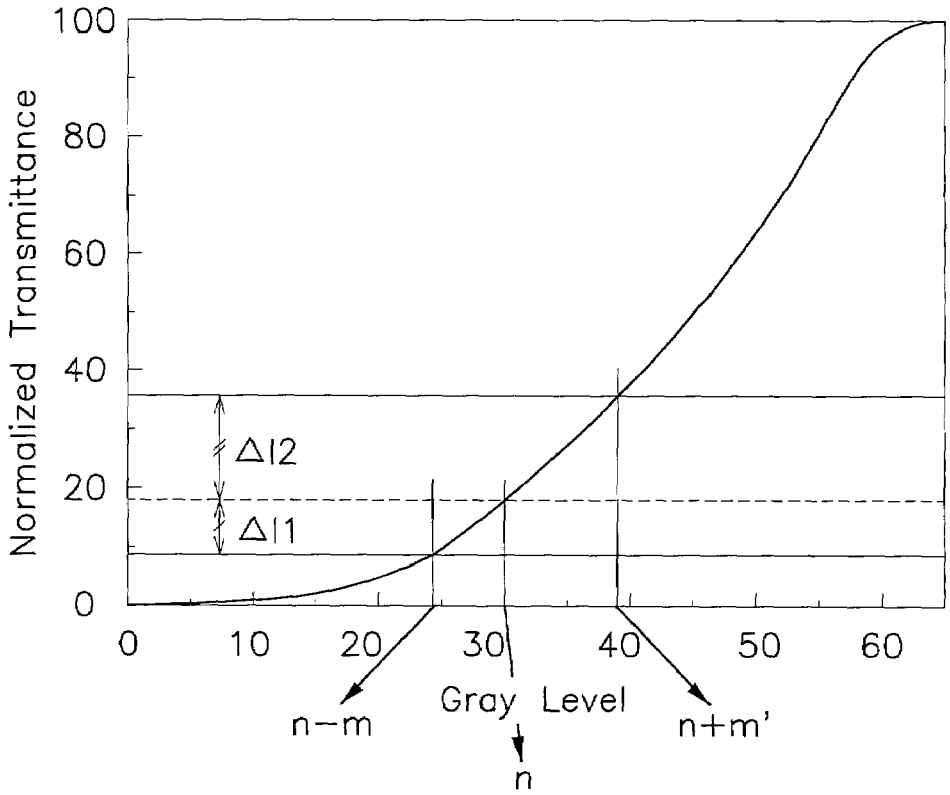
FIG. 12 is a graph showing an operation of m and m' for a particular n on a gamma curve of FIGS. 11*a* and 11*b*.

FIG. 12 is a graph for illustrating operation of m and m' for a particular n on a gamma curve of FIGS. 11*a* and 11*b*.

Referring to FIG. 12, as a particular gray level is assigned, designers of the LCD calculate ΔI1 and ΔI2 in which gray level inversion is not generated within a range in which visibility is not seriously affected while setting any m and m' values and obtain m and m' values corresponding to the operated ΔI1 and ΔI2, respectively. At that time, the values of ΔI are different one another for each gray level, but a particular gray level has same ΔI.

As shown in FIG. 12, m' in which gray level inversion is not generated within a range in which visibility is not seriously affected while adjusting the value of m' may be obtained.

If full gray level of the liquid crystal display is assumed to be 64 gray levels, conditions of (n+m)>64 or (n−m')<0 can be satisfied in gray levels close to white and black. At that time, m and m' satisfying conditions of (n+m)=64 or (n−m')=1 are used.

Here, a relation among n, m and m' can be represented as the following expression.

$$I(n) = \frac{2I(n-m) + I(n+m')}{3}$$

where, if full gray level of the liquid crystal display is assumed to be 64 gray levels, n is 64 for white gray level and 1 for black gray level. Also, m and m' are the first gray level correction value and the second gray level value, respectively, and m+m' is preferably at least 20.

In two embodiments of the present invention described above, although it has been illustrated to perform a calculation through a procedure for averaging gray levels applied to a particular pixel spatially arranged in a particular time-variant frame and another pixel proximate to the particular pixel in order to average at least two gray levels and store the first and second gray level correction values in a memory, it is possible to average the gray levels applied to a previous frame and a current frame which are variant in time in the particular spatially arranged pixel.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A liquid crystal display for wide viewing angle, comprising:

a timing controller for storing a plurality of sets of gray level correction values, each set of gray level correction values includes first and second gray level correction values corresponding to each gray level data and generating corrected gray level data in response to input gray level data, the corrected gray level data reflecting the gray level correction values corresponding to the input gray level data;

a gate driver for outputting sequentially predetermined scanning signals;

a data driver for receiving the corrected gray level data and transforming them into predetermined data voltages to be outputted; and a liquid crystal panel for displaying an image based on the data voltages when the scanning signals are inputted, wherein a lookup table stores the first and second grey level correction values produced by time-averaging brightness exhibited by more than two voltages using an inversion method or a method of optimizing a brightness pattern for each frame and thus brightness of the corrected gray level data is time-averaged with respect to the more than two voltages for each frame to be equal to brightness of the input gray level data.

2. The liquid crystal display of claim 1, wherein the corrected gray level data reflects the gray level correction values corresponding to a plurality of sub-pixels of RGBs, when the input gray level data includes the sub-pixels of each of the RGBs.

3. The liquid crystal display of claim 1, wherein said timing controller includes a signal processing unit for producing and outputting a first control signal to be inputted to the data driver, a second control signal to be inputted to the gate driver, and a third control signal to be inputted to a driving voltage generating unit; and a gray level averaging unit for generating the corrected gray level data.

4. The liquid crystal display of claim 3, wherein said gray level averaging unit outputs the corrected gray level data in synchronization with line inversion signals (RVS) included in the third control signal.

5. The liquid crystal display of claim 3, wherein said gray level averaging unit includes a memory for storing a first gray level correction value arid a second gray level correction value; and a data processing unit for extracting the first or second gray level correction value from said memory as the gray level data of each of RGBs are inputted and outputting the corrected gray level data reflecting the first or second gray level correction value.

6. The liquid crystal display of claim 5, wherein said data processing unit outputs the corrected gray level data reflecting the first or second gray level correction value for each of a plurality of frames.

7. The liquid crystal display of claim 5, wherein the first and second gray level correction values are determined such that brightness of the first and second gray level correction values is time-averaged to be equal to brightness of the input gray level data.

8. The liquid crystal display of claim 5, wherein the first and second gray level correction values are determined such that brightness of the first and second gray level correction values is time-averaged to be equal to brightness of the gray level data.

9. The liquid crystal display of claim 1, wherein the first gray level correction value is a voltage value for driving pixel electrodes of the liquid crystal panel at a level lower than the input gray level data, and the second gray level correction value is a voltage value for driving the pixel electrodes of the liquid crystal panel at a level higher than the input gray level data.

10. The liquid crystal display of claim 1, wherein the liquid crystal panel comprises liquid crystals of TN mode.

11. The liquid crystal display of claim 1, wherein the liquid crystal panel comprises an increased generation angle of a lower gray level inversion.

12. A driving method of a liquid crystal display including a plurality of gate lines, a plurality of data lines intersecting the plurality of gate line perpendicularly, pixel electrodes formed in regions between the gate lines and the data lines, and switching devices connected to the gate lines, the data lines, and the pixel electrodes, the method comprising:

storing a plurality of sets of gray level correction values, each set of gray level correction values includes first and second gray level correction values corresponding to each gray level data;

receiving input gray level data for picture display from an external source of picture signal;

generating corrected gray level data in response to the input gray level data, the corrected gray level data reflecting the gray level correction values corresponding to the input gray level data;

converting the corrected gray level data into data voltages;

applying the data voltages to the data lines; and applying sequentially scanning signals for output of the data voltages to the gate lines, wherein a lookup table stores the first and second gray level correction values produced by time-averaging brightness exhibited by more than two voltages using an inversion method or a method of optimizing a brightness pattern for each frame and thus brightness of the corrected gray level data is time-averaged with respect to the more than two voltages for each frame to be equal to brightness of the input gray level data.

13. The driving method of claim 12, wherein generating corrected gray level data comprises:

extracting from a memory first and second gray level correction values corresponding to the input gray level data; and generating the corrected gray level data reflecting the first and second gray level correction values.

14. The driving method of claim 13, wherein the first gray level correction value is a voltage value for driving the pixel electrodes at a level lower than the input gray level data, and the second gray level correction value is a voltage for driving the pixel electrodes at a level higher than the input gray level data.

15. The driving method of claim 13, wherein the corrected gray level data generates a first corrected gray level data by subtracting the first gray level correction value from the input gray level data, the first average gray level data being applied when odd or even numbers of frames are driven, and a second corrected gray level data by adding the second gray level correction value to the input gray level data, the second corrected gray level data being applied when odd or even number of frames are driven.

16. The driving method of claim 13, wherein the corrected gray level data is the first gray level correction value corresponding to the input gray level data when the odd numbers of frames are driven and the second gray level correction value corresponding to the input gray level data when the even numbers of frames are driven.

17. The liquid crystal display of claim 5, wherein the memory includes a lookup table.

18. The driving method of claim 13, wherein the memory includes a lookup table.

* * * * *